US006870454B1

(12) United States Patent
Vladimirescu et al.

(10) Patent No.: US 6,870,454 B1
(45) Date of Patent: Mar. 22, 2005

(54) LINEAR SWITCH ACTUATOR

(75) Inventors: Mihai Vladimirescu, Cambridge (CA); Regina Kwiatkowski, Cambridge (CA)

(73) Assignee: Com Dev Ltd., Cambridge (CA)

( * ) Notice: Subject to any disclaimer, the term of this patent is extended or adjusted under 35 U.S.C. 154(b) by 0 days.

(21) Appl. No.: 10/656,257

(22) Filed: Sep. 8, 2003

(51) Int. Cl.[7] ..... H01F 7/08
(52) U.S. Cl. ..... 335/220; 335/256
(58) Field of Search ..... 335/4–5; 333/104–105

(56) References Cited

U.S. PATENT DOCUMENTS

| | | | | | |
|---|---|---|---|---|---|
| 3,088,081 | A | | 4/1963 | Conceiman | |
| 3,274,522 | A | * | 9/1966 | Heller | 335/5 |
| 3,689,854 | A | | 9/1972 | Brastow et al. | |
| 4,243,899 | A | * | 1/1981 | Jaffe | 310/14 |
| 4,490,701 | A | * | 12/1984 | Dietrich et al. | 335/78 |
| 4,604,599 | A | * | 8/1986 | Koehler | 335/230 |
| 4,747,010 | A | | 5/1988 | Bayer | |
| 4,851,801 | A | | 7/1989 | Engel | |
| 4,855,699 | A | | 8/1989 | Hoegh | |
| 5,075,656 | A | | 12/1991 | Sun et al. | |
| 5,281,936 | A | | 1/1994 | Ciezarek | |
| 5,652,558 | A | * | 7/1997 | Leikus et al. | 335/4 |
| 5,724,014 | A | | 3/1998 | Leikus et al. | |
| 6,040,752 | A | * | 3/2000 | Fisher | 335/234 |
| 6,133,812 | A | | 10/2000 | Magda | |
| 6,590,483 | B2 | | 7/2003 | Suzuki | |
| 2002/0008601 | A1 | | 1/2002 | Yajima et al. | |
| 2002/0149456 | A1 | * | 10/2002 | Krimmer et al. | 335/220 |

* cited by examiner

*Primary Examiner*—Elvin Enad
*Assistant Examiner*—Bernard Rojas
(74) *Attorney, Agent, or Firm*—Bereskin & Parr; Isis E. Caulder

(57) ABSTRACT

A linear switch actuator for actuating a movable element within a microwave switch includes a ferromagnetic shield, a coil positioned within, and a movable armature assembly positioned within the coil. The armature assembly is coupled to the movable element and includes a ferromagnetic rod and first and second permanent magnets. The permanent magnets are coupled on either end of the rod and have opposite pole orientations. The armature assembly moves between first and second stroke end positions. When one of the permanent magnets is positioned substantially outside the shield, the magnetic permeance of the armature assembly is maximized, and the armature assembly experiences bi-stable latching between the two stroke end positions. When the coil is energized, the armature assembly moves between these positions due to magnetic interaction between the energized coil and the field associated with the permanent magnets and the solenoid magnetic field associated with the coil which reduces the magnetic permeance associated with said armature assembly.

7 Claims, 14 Drawing Sheets

$$mmf = N \lozenge I$$

$$R_{mk} = \frac{L_{mk}}{\mu_{mk} \lozenge A_{mk}}$$

$$R_{me} = \sum_k R_{mk}$$

$$\Phi = \frac{mmf}{R_{me}}$$

$$F = \frac{\Phi^2}{2 \lozenge \mu_0 \lozenge A}$$

$$mmf = N \lozenge I$$

$$R_{mk} = \frac{L_{mk}}{\mu_{mk} \lozenge A_{mk}}$$

$$R_{me} = \sum_k R_{mk}$$

$$\Phi = \frac{mmf}{R_{me}}$$

$$F = -\frac{1}{2} \lozenge \Phi^2 \lozenge \frac{dR_{mg}}{dx}$$

LINEAR SWITCH ACTUATOR

FIELD OF THE INVENTION

This invention relates to microwave switch actuators and more particularly to a linear actuator for a microwave switch.

BACKGROUND OF THE INVENTION

Electromechanical microwave switches use electromagnetic actuators to change switch states by moving switch active elements such as RF reeds. Electro-magnetic switch actuators need to provide latching to allow the microwave switch to be powered up for only a short time period during switching. Intrinsic latching maintains the switch state during mechanical vibrations or shocks, ensures good electrical contact between the contacts, and provides extra reliability. Electromagnetic switch actuators also need to have low mass and small volume since actuators typically account for more than one half of the switch mass. The inertia forces are proportional to the mass of the mobile armature, and therefore the amount of latching force/torque necessary to maintain the switch position increases with mass, requiring a higher active force and larger actuator.

Electromechanical switches employed in microwave communications are generally either switches with rotary actuators or switches with linear actuators. Linear electromagnetic actuators basically break down into three categories, namely electromagnetic actuators (that utilize the tractive force), voice coil actuators (that utilize the Lorentz force), and solenoid actuators (that utilize the reluctance force). There are several weaknesses associated with each of these types of linear actuators. Electromagnetic actuators, voice coil actuators and solenoid actuators do not have an intrinsic latching mechanism and accordingly an external separate latching mechanism is generally required. For electromagnetic actuators and solenoid actuators, since actuation is only possible in a single direction, the use of either elastic elements (e.g. springs) or additional actuators are required to provide bi-directional functionality. Further, linear actuators generally exert their lowest force at the beginning of the stroke and their highest force at the end of the stroke. This is problematic since a large force is required at the beginning of the stroke in order to overcome latching forces. If actuators are simply made larger to overcome latching forces, the increased (i.e. very high) force at the end of the stroke results in excessively high mechanical impacts on switch contacts. Finally, voice coil actuators having a size that is compatible with microwave switch applications do not generally provide sufficient magnetic force for practical microwave switch applications.

More specifically, as shown in FIG. 1, electromagnetic actuators utilize an electromagnet 2 having stationary coils which attract a mobile armature 5. The tractive force F that is associated with the electromagnet 2 is related to the magnetic flux $\Phi$ that exists within the air-gap of the electromagnet 2, the magnetic permeability of free space $\mu_0$, the area of pole regions A, the magnetomotive force of the coil mmf, the number of turns of the electromagnetic coil N, the electric current I through the electromagnet 2, the magnetic reluctance $R_{mk}$ for the circuit element k, the length $L_{mk}$ of the circuit element k and the equivalent magnetic reluctance $R_{me}$ of the circuit. The direction of the tractive force F generated does not depend on the direction of the current due to the fact the value of magnetic flux is squared in the force relation. Accordingly, a switch actuator that utilizes tractive force F is not bi-directional. Also, the magnetic force is minimal at the maximum gap since the magnetic reluctance is highest at the maximum gap resulting in lowest flux value. Conventional switch tractive force based actuators utilize armatures made of soft magnetic material that provide no intrinsic latching and must rely on external elements to provide latching. The tractive force based actuator disclosed in U.S. Pat. No. 5,075,656 to Sun et al. utilizes an armature made out of a permanent magnet to achieve intrinsic latching and bi-directional motion. However, changing the armature from soft magnetic material to a permanent magnet results in a significant increase in the reluctance of the magnetic armature since $\mu_{PMAGNET} << \mu_{SOFT\ CORE}$. Accordingly, the magnetic flux and the magnetic force will decrease significantly. For these reasons, these types of actuators are of very limited use and can be used only where an exceptionally short stroke is adequate.

FIG. 2 illustrates the basic operating principle of the Lorentz force upon which voice coil actuators are based. The interaction of a magnetic field B with the current I in a coil wire 3 generates the well-known Lorentz force. Either the coil wire 3 or the armature can be used as the mobile element within the actuator. The formulas listed in FIG. 2 that are used to calculate force F are based on the assumption that a charge q is traveling a length L of coil wire 3. The direction of the magnetic force generated depends on the direction of the electric current I running through a coil wire 3. Accordingly, the actuator is bi-directional. There is no intrinsic latching associated with a voice coil actuator based only on the Lorentz force since the force results only from interaction between the current I and the magnetic field B. For a constant current I, the force magnitude F is quasi-constant with the stroke. This is due to the fact that the force magnitude F depends only on magnetic flux density. The flux density remains constant because the magnetic flux direction is perpendicular to the direction of the stroke. The major disadvantage of a conventional voice coil actuator for microwave switch applications is that increasing the number of coil turns does not increase the magnetic force F generated. Rather, increasing number of turns increases the gap which in turn results in a decrease of the magnetic flux that intersects the coil turns. A voice coil actuator having a size and mass that is compatible with typical microwave switch dimensions can only generate a maximum force in the vicinity of 10 grams, which is not sufficient in practice for microwave switch applications.

Conventional solenoid actuators are normally constructed by winding a coil of wire 6 around a moveable soft iron core plunger 4 as shown in FIG. 3. Wire coil 6 is wound around plunger 4 and current is provided to the coil in such a direction such that the portion labeled as "A" represents current flowing out of the plane of the figure and that the portion labeled as "B" represents current flowing into the plane of the figure. Accordingly, the direction of the magnetic flux $\Phi$ is shown by the arrowed line surrounding coil 6. As shown, reluctance force F is exerted upon plunger 4. The direction of the reluctance force F does not depend on the direction of the current since as with tractive force based actuators, the value of magnetic flux is squared in the force relation as shown. Accordingly, the solenoid actuator is not bi-directional. The direction of the force depends only of the direction that reduces the reluctance. The force is minimal at the maximum gap. Conventional solenoid actuators utilize soft magnetic material and as such possess no intrinsic latching. In an attempt to obtain bi-directional motion, solenoid actuators have been designed to utilize a permanent magnet for the plunger 4 as disclosed in U.S. Pat. Application No. 2002/0,008,601 to Yajima et al. However, in such a case, the reluctance of the plunger will increase significantly since $\mu_{PMAGNET} << \mu_{SOFT\ CORE}$ and the magnetic flux and the magnetic force will decrease causing the actuator to be inefficient. Another variant of the conventional solenoid actuator is the use of an additional elastic element (e.g. springs) to achieve the return stroke as disclosed U.S. Pat. No. 6,133,812 to Magda or U.S. Pat. No. 5,724,014 to Leikus et al. However, it is not desirable because the mechanical characteristics of elastic elements (e.g. springs) vary during the course of the actuator life and as such, important switch parameters, such as contact forces, latching stiffness etc. vary over time.

SUMMARY OF THE INVENTION

The invention provides in one aspect, a linear switch actuator for actuating a movable element within a microwave switch, said linear switch actuator comprising:

(a) a ferromagnetic shield having an interior region and first and second apertures;

(b) a magnetic coil having a longitudinal axis and positioned within the interior region of said shield and adapted to receive an energizing current;

(c) a moveable armature assembly adapted to be coupled to the movable element and positioned along the longitudinal axis of said coil and extending through the first and second apertures of said shield, said armature assembly being moveable between a first stroke end position and a second stroke end position, said armature assembly comprising:

(i) a ferromagnetic rod having a first end and a second end;

(ii) a first permanent magnet coupled to said first end of the rod and positioned within said first aperture, said first permanent magnet having a first pole orientation and being positioned substantially outside said shield at the first stroke end position;

(iii) a second permanent magnet being coupled to said second end of said rod and positioned within said second aperture and having a second pole orientation opposite to that of the first pole orientation, said second permanent magnet and being positioned substantially outside said shield at the second stroke end position;

(d) such that when said armature assembly is positioned at one of said first and second stroke end positions, the magnetic permeance associated with said armature assembly is maximized due to one of said first and second permanent magnets being positioned substantially outside said shield, resulting in bi-stable latching between said first and second stroke end positions; and (e) such that when said energizing current is applied to said coil, said armature assembly moves between said first and second stroke end positions due to the combination of the force exerted on said armature assembly due to the magnetic interaction between said energized coil and the field associated with said first and second permanent magnets and the solenoid magnetic field associated with said coil which reduces the magnetic permeance associated with said armature assembly.

Further aspects and advantages of the invention will appear from the following description taken together with the accompanying drawings.

DETAILED DESCRIPTION OF THE INVENTION

Figure 1:
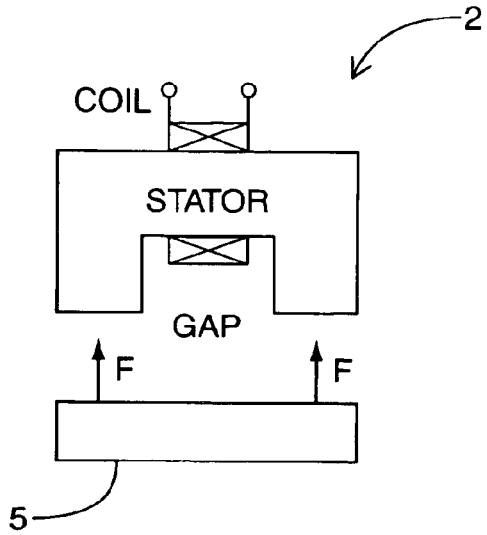
FIG. 1 PRIOR ART
FIG. 1 is a schematic diagram describing the operation of a prior art electromagnetic actuator.
Figure 1:
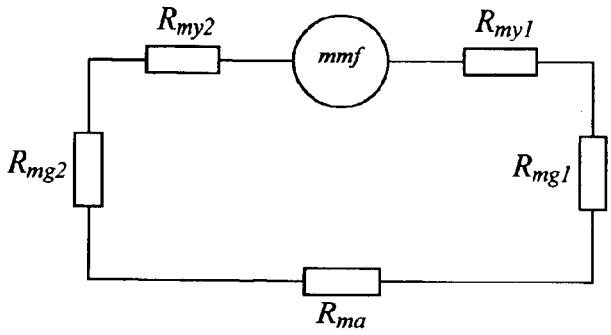
FIG. 1 PRIOR ART
Figure 2:
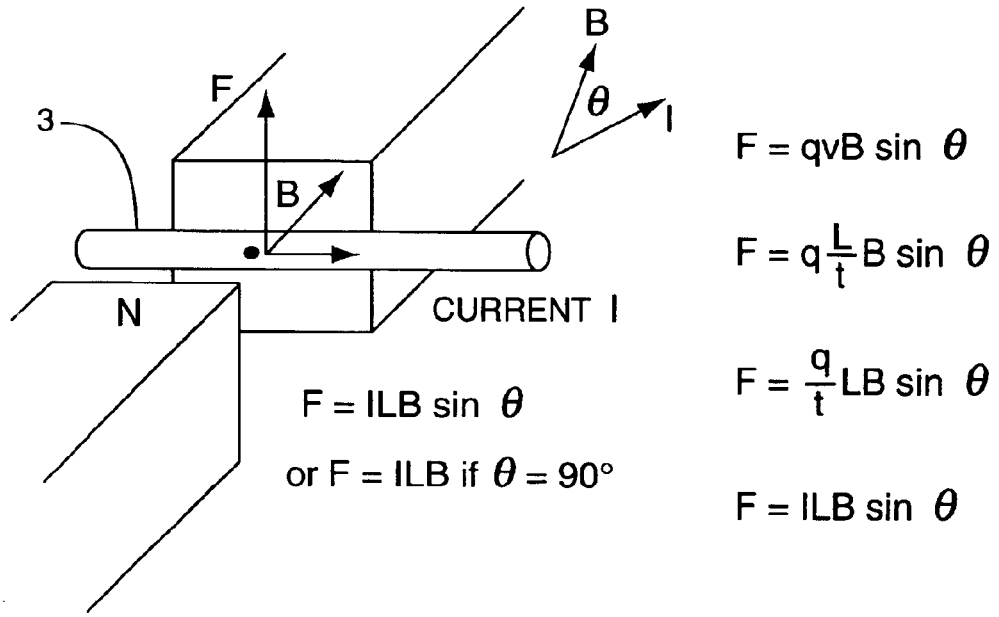
FIG. 2 PRIOR ART
FIG. 2 is a schematic diagram describing the Lorentz force upon which prior art voice coil actuators are based.
Figure 3:
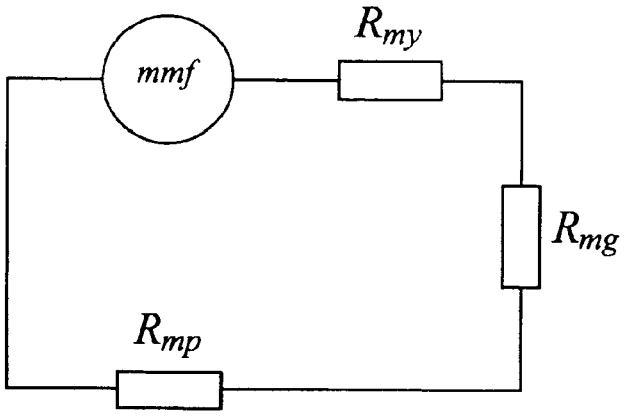
FIG. 3 PRIOR ART
FIG. 3 is a schematic diagram describing the operation of a prior art solenoid actuator.
Figure 3:
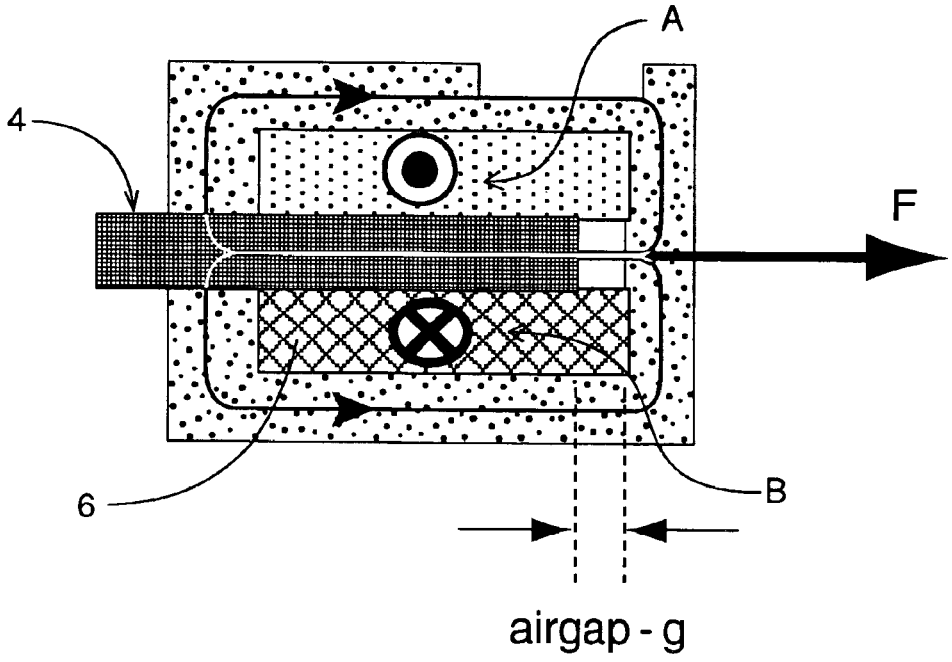
FIG. 3 PRIOR ART
Figure 4:
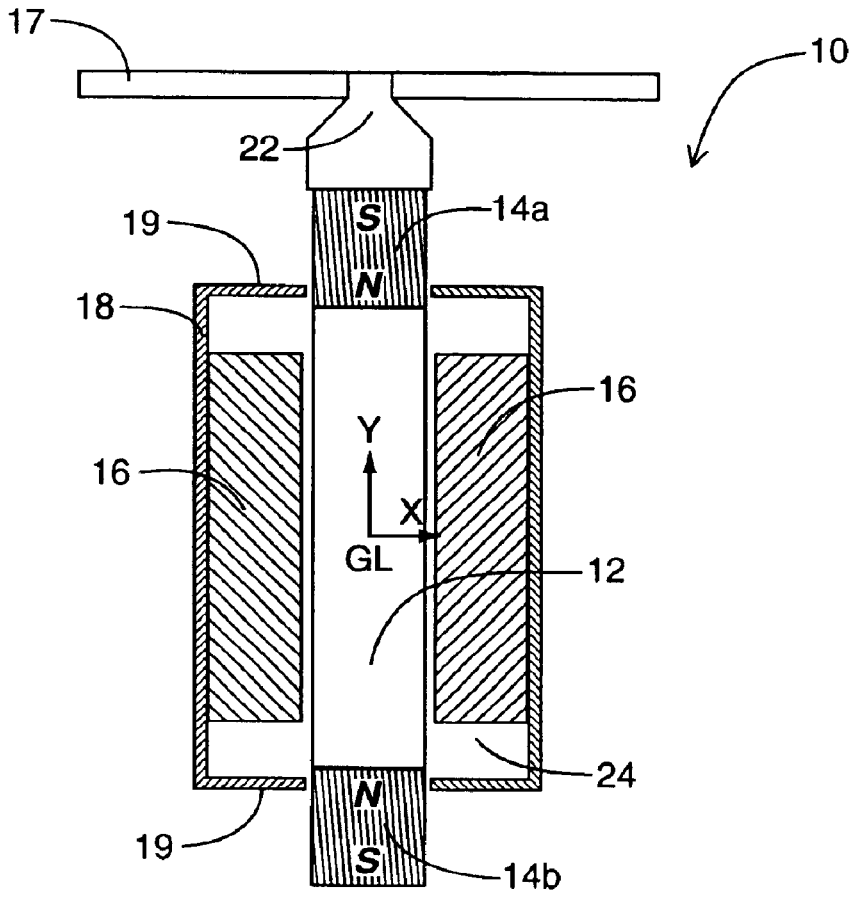
FIG. 4 is a cross-sectional view of the linear switch actuator of the present invention.

FIG. 4 illustrates a linear switch actuator 10 built in accordance with the present invention. Specifically, linear switch actuator 10 includes a mobile armature rod 12, permanent magnets 14*a* and 14*b*, an electromagnetic coil 16, a shield 18 having ferromagnetic end plates 19, and an armature piston 22. Permanent magnets 14*a*, 14*b* are coupled to the ends of armature rod 12, one at each end having a pole orientation as shown. Armature rod 12 is surrounded by coil 16, and both armature rod 12 and coil 16 are encased within shield 18. Current is provided to coil 16 in two directions which allows actuator 10 to operate bi-directionally. Linear switch actuator 10 utilizes the Lorentz force as well as associated magnetic reluctance (solenoid) forces that exist within the specific configuration of armature rod 12, permanent magnet 14*a* and 14*b* and coil 16 of the present invention to provide actuation. Also, the magnetic reluctance (solenoid) forces provide an intrinsic latching mechanism when coil 16 is not energized, as will be described.

Armature rod 12 is a cylindrical rod, preferably made from a soft ferromagnetic material with a high value of relative permeability, such as steel selected for high magnetic permeability, high saturation levels, and extremely low coercivity (e.g. nickel or cobalt steel alloys).

Permanent magnets 14*a* and 14*b* are coupled to the ends of armature rod 12 using epoxy bonding. Permanent magnets 14*a* and 14*b* are oriented such that like poles face each other. Specifically, FIG. 4 shows the pole orientation of permanent magnet 14*a* to be S-N (S at the top, N at the bottom) and the pole orientation of permanent magnet 14*b* to be N-S(N at the top and S at the bottom) such that the like poles N are facing each other. However, it should be understood that the permanent magnets 14*a* and 14*b* could also be oriented in the opposite fashion so that like poles S are facing each other. Therefore, permanent magnets 14*a* and 14*b* are orientated such that the generated magnetic bias is directed axially with respect to armature rod 12. Permanent magnets 14*a* and 14*b* are preferably made from high-energy permanently magnetic materials such as sintered rare-earth magnets (e.g. samarium cobalt or neodymium iron boron alloys), although other permanently magnetic materials can be utilized. Accordingly, armature rod 12 and permanent magnets 14*a* and 14*b* together make up a moveable armature assembly that moves bi-directionally within coil 16 as will be described.

Coil 16 is a conventional annular electromagnetic coil wound around a conventional bobbin 24. Coil 16 is oriented to be axially aligned with armature rod 12 and permanent magnets 14*a* and 14*b* along a longitudinal axis. Also, coil 16 is designed to surround a substantial amount of the combination of the armature rod 12 and permanent magnets 14*a* and 14*b* as shown in FIG. 4. Coil 16 is preferably made from standard magnetic wire (e.g. copper) of ultra fine gauge (e.g. AWG 40 or finer) although various metal materials and thicknesses may be utilized. Coil 16 is a single coil in the case where the associated controller has bipolar drive capability. In the case of unipolar command, coil 16 is typically bi-filar magnet wire to allow for different current sense in the two wires.

Shield 18 encapsulates coil 16, armature rod 12, and at least a portion of permanent magnets 14*a* and 14*b*. The amount of permanent magnet 14*a* and 14*b* surrounded by shield 18 depends on the position of mobile armature rod 12 and associated permanent magnets 14*a* and 14*b* within shield 18. Shield 18 is preferably made from soft ferromagnetic steels selected for high magnetic permeability, high saturation levels, and extremely low coercivity (e.g. nickel or cobalt steel alloys). Shield 18 includes ferromagnetic end plates 19 which are made from a magnetic material having a relatively high permeability (i.e. similar to that used within the rest of shield 18). Ferromagnetic end plates 19 complete the magnetic return path for the magnetic field generated by permanent magnets 14*a* and 14*b*. Specifically, when permanent magnet 14*a* or 14*b* is positioned substantially on the outside of the associated magnetic end plate 19, this ferromagnetic end plate 19 becomes the dominant return path and the resulting magnetic fields are largely "isolated" or "localized" from the armature rod 12. Accordingly, shield 18 provides magnetic return path for the magnetic field generated by permanent magnets 14*a* and 14*b* in conjunction with armature rod 12. The extremely low coercivity of both shield 16 and armature rod 12 permits actuator 10 to smoothly operate between stroke end states without any hysteresis-related impediments (i.e. associated with loss of permeance). Also, it should be understood that since it is desirable to pack as many coils in a space efficient manner between armature rod 12 and shield 18, it is preferable for shield 18 to be substantially cylindrical and axially aligned with coil 16. However, shield 18 could also be some other shape and/or orientated off-axis with respect to coil 16, although such variations would result in actuator 10 having reduced efficiency.

Armature piston 22 is attached to the armature assembly and is used to actuate (i.e. apply pressure to) a movable element 17 within a Radio Frequency (RF) microwave switch (not shown) as will be further described. Armature piston 22 is shown coupled to permanent magnet 14*a*, but it should be understood that armature piston 22 could be coupled to the outside surface of either permanent magnet 14*a* or 14*b*.

Figure 5A:
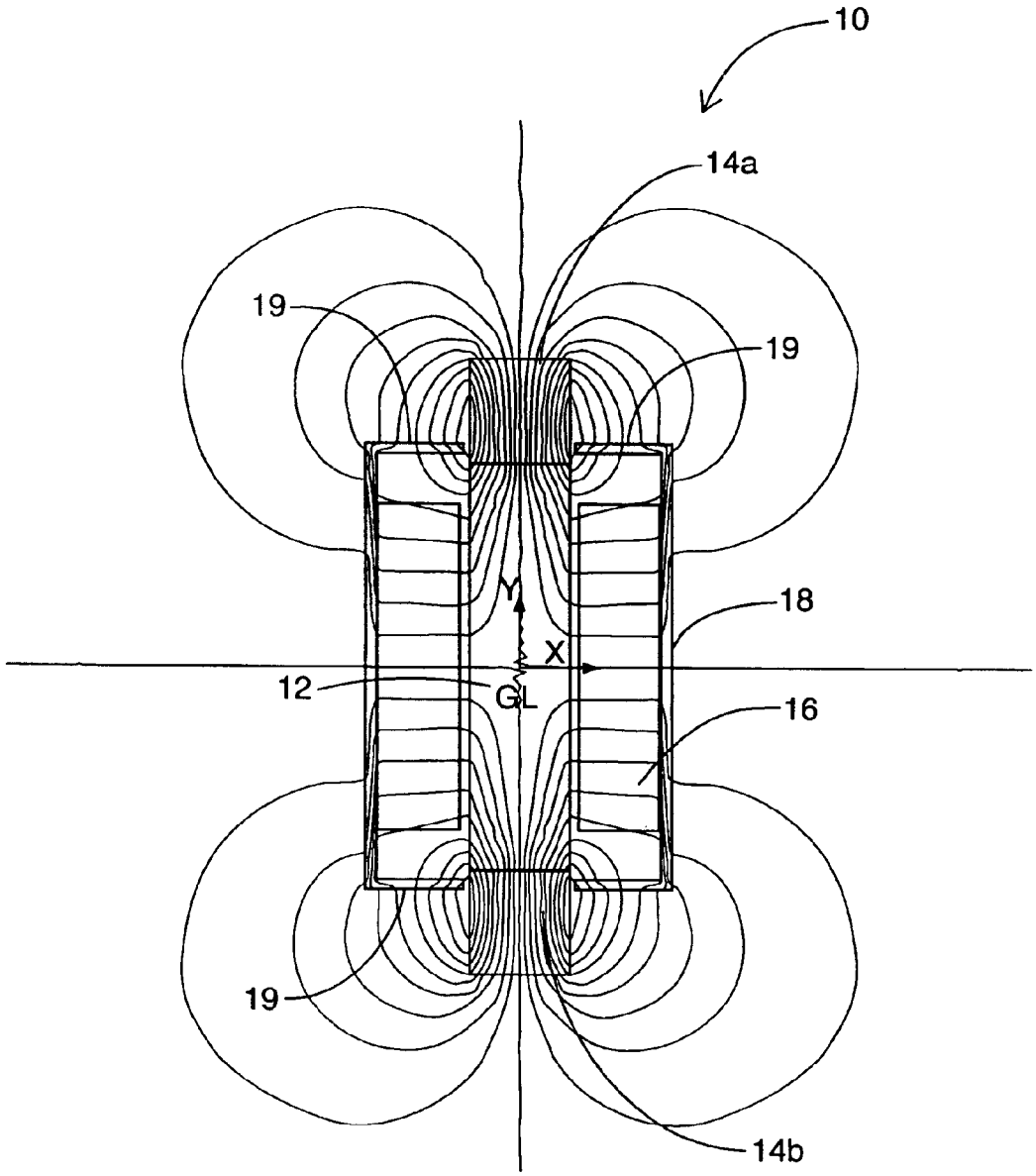
FIG. 5A is a schematic view showing the magnetic field distribution associated with the actuator of FIG. 4 when the actuator rod is in center position and the coil is not energized.

Referring now to FIGS. 4, 5A, 5B, 5C, the intrinsic latching mechanism of linear switch actuator 10 will be described. Specifically, the magnetic characteristics that are produced when actuator rod 12 and permanent magnets 14*a* and 14*b* move within an un-energized coil 16 and shield 18 are shown. As shown in FIG. 5A, armature rod 12 is in the symmetrical center of its permitted travel path (i.e. it's center position) within actuator 10. It should be noted that it is assumed that coil 16 is not energized (i.e. no current is flowing through coil 16) for illustrative purposes. The resulting magnetic field distribution is shown. The magnetic flux emanating from permanent magnets 14*a* and 14*b* enters the ends of the armature rod 12 and subsequently exits the armature rod 12 radially toward the shield 18. Shield 18 facilitates the return path through ferromagnetic end plates 19 to the opposite magnet poles within permanent magnets 14*a* and 14*b* by providing a low reluctance path.

Figure 5B:
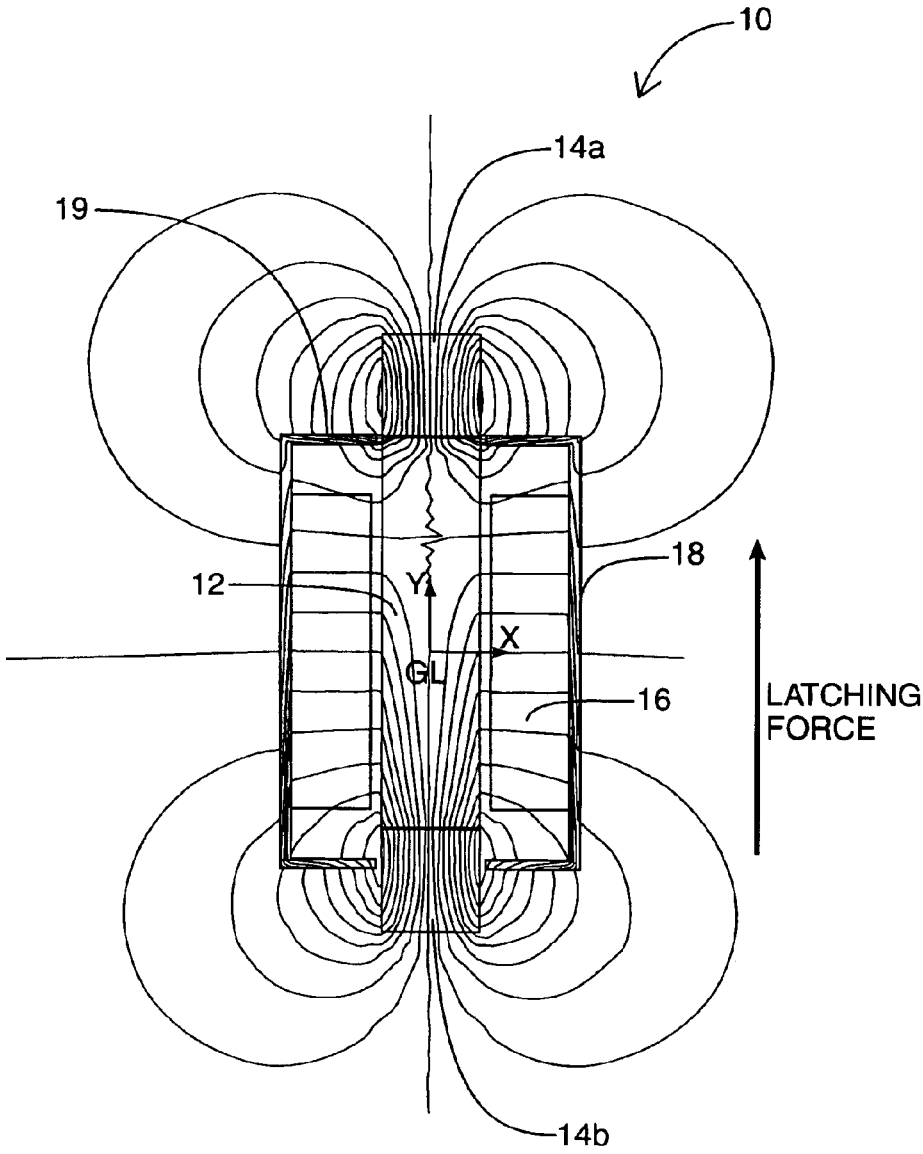
FIG. 5B is a schematic view showing the magnetic field distribution associated with the actuator of FIG. 4 when the actuator rod is in an actuator stroke end position and the coil is not energized.

In contrast, as shown in FIG. 5B, actuator rod 12 is shown at the end of its stroke. Again coil 16 is assumed not to be energized (i.e. no current is flowing through coil 16) for illustrative purposes. In this asymmetric state, permanent magnet 14*a* is substantially displaced outside the interior region of shield 18. As a result of this, the magnetic flux associated with permanent magnet 14*a* is largely localized and isolated from the armature rod 12. Also, along with the upward movement of actuator rod 12, permanent magnet 14*b* has penetrated further into the interior region of shield 18. As a result of the position of permanent magnet 14*b* within shield 18, the flux path from permanent magnet 14*b* incorporates a significant portion of actuator rod 12 and shield 18.

This in turn significantly improves the magnetic permeance (i.e. an increase in the ability of actuator 10 to conduct magnetic flux) within actuator 10. The increase in magnetic permeance associated with penetrating permanent magnet 14*b* exceeds the loss of magnetic permeance associated with isolated permanent magnet 14*a* resulting in a net increase in overall magnetic permeance. This means that near the end of a stroke, actuator 10 is in a lower energy state than it is near the middle of the stroke. Practically, this means that at the end of a stroke, a latching force (as shown in FIG. 5B) exists within actuator 10 to push the armature rod 12 and associated permanent magnets 14*a* and 14*b* away from the center of the shield which in turn holds armature rod 12 and associated permanent magnets 14*a* and 14*b* in place and the end of a stroke.

Figure 5C:
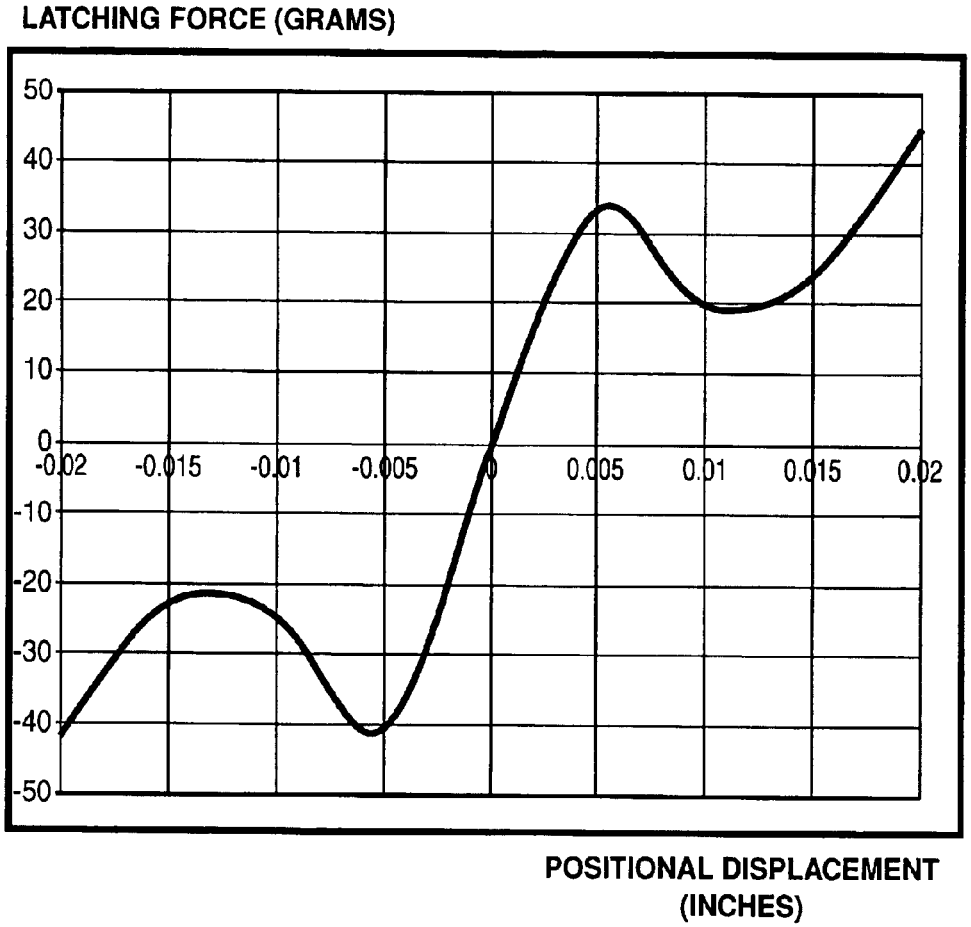
FIG. 5C is a graph showing the magnetic latching force versus the positional displacement of actuator rod within the actuator of FIG. 4 over the course of an actuator stroke when the coil is not energized.

FIG. 5C is a graph that illustrates the latching force versus positional displacement of actuator rod 12 from a center position (i.e. center is when positional displacement is ="0")

over an entire stroke. As shown, maximum latching force is exhibited at the two stroke ends as discussed above. Also, actuator rod 12 exhibits a bi-stable latching condition with a pronounced "over center snap" between positional displacements of −0.005 and +0.005 inches from center position. As shown in FIGS. 5A and 5B, comparable flux paths are produced and oriented radially through coil 16 (e.g. typically 0.2 Tesla in most embodiments). It should be understood that while the performance characteristics of the graph in FIG. 5C are associated with S-N pole orientation (S facing up and N facing down) of permanent magnet 14*a* and pole orientation N-S(N facing up and S facing down) of permanent magnet 14*b*, actuator 10 will operate similarly with a reverse pole orientations (i.e. N—S(N facing up and S facing down) polarity of permanent magnet 14*a* and S-N pole orientation (S facing up and N facing down) of permanent magnet 14*b*).

Now referring to FIGS. 4, 6, 7A and 7B, the magnetic characteristics associated with the movement of actuator rod 12 and permanent magnets 14*a* and 14*b* within an energized coil 16 will be described. Current is applied to coil 16 in a direction that is tangential to the surface of cylindrical actuator rod 12. The result is a Lorentz force on coil 16 in a direction parallel to this cylindrical axis as shown. In reaction, an equal and opposite force is exerted on the permanent magnets 14*a* and 14*b* and armature rod 12 assembly. This reaction force constitutes a nearly constant force along the extent of the stroke. Reversing the current direction in coil 16 reverses the force direction. This force represents part of the active actuation means.

Figure 6:
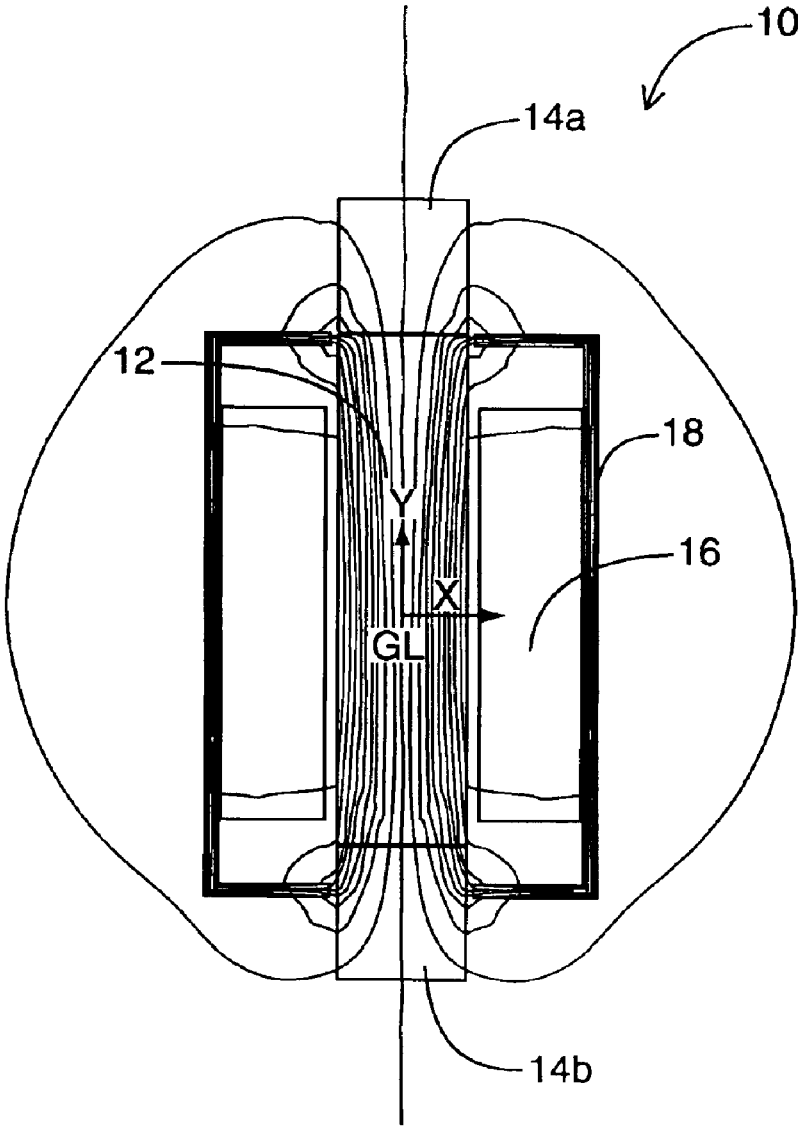
FIG. 6 is a schematic view showing the magnetic field induced by the coil of FIG. 4 in the ferromagnetic actuator rod alone when energized.

FIG. 6 illustrates the magnetic field distribution induced by the energized coil 16 alone (i.e. for this illustration it is assumed that permanent magnets 14*a* and 14*b* have been replaced with steel and that coil 16 is energized). This illustration shows the typical solenoid magnetic field associated with coil 16.

Figure 7A:
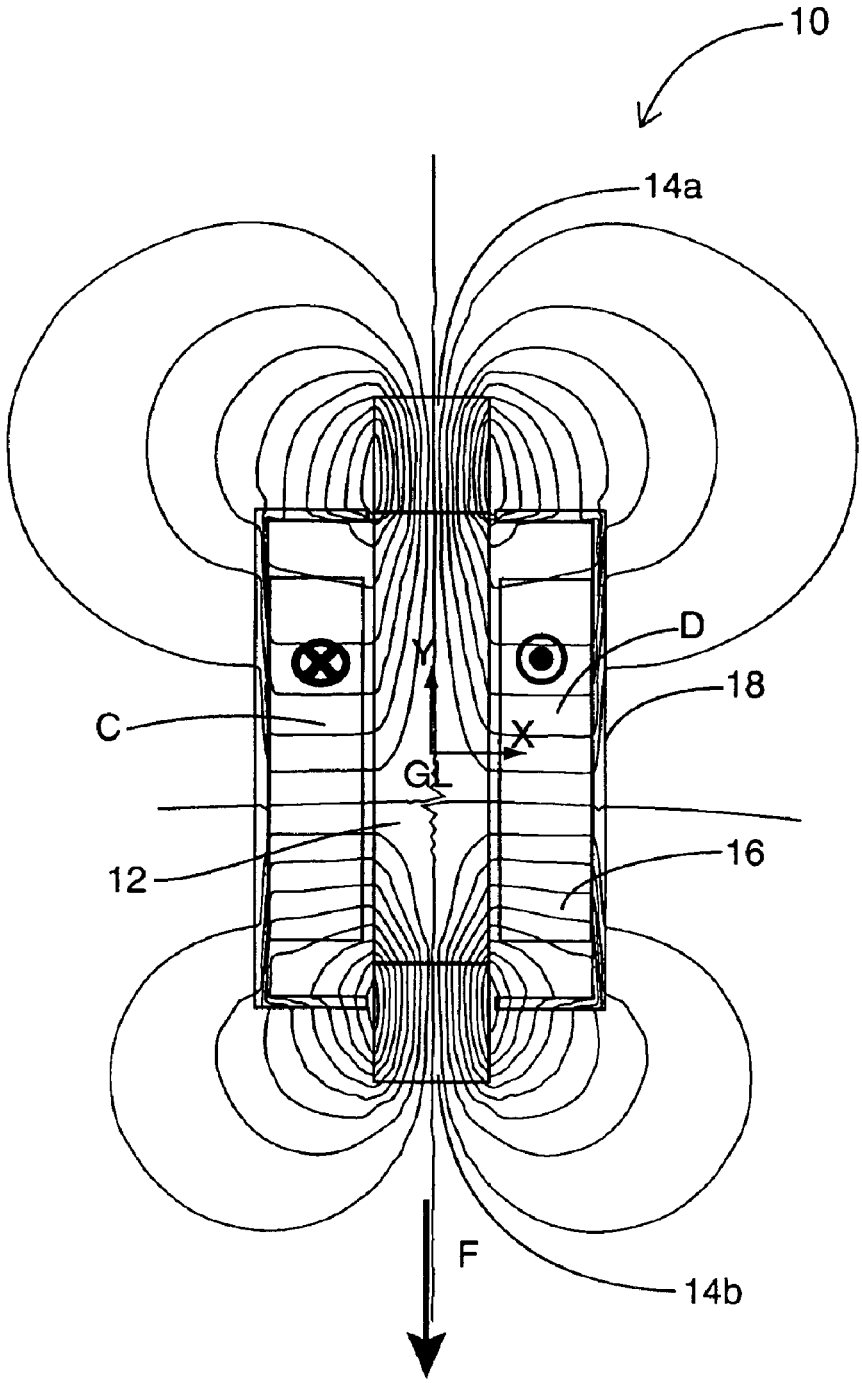
FIG. 7A is a schematic view showing the relationship between the magnetic field of the energized coil and the magnetic field associated with the actuator of FIG. 4 at the start of a stroke.

FIG. 7A illustrates the magnetic field distribution associated with actuator 10 at the start of an actuator stroke. At this point, armature rod 12, is latched in an upper position (as previously discussed in respect of FIG. 5B). The magnetic field created thereby will retain the permanent magnets 14*a* and 14*b* and armature rod 12 assembly in the latched (i.e. in this case, upper) position before the coil 16 is energized. When coil 16 is energized by current flowing in such a direction that the portion labeled as "C" represents current flowing into the plane of the figure and that the portion labeled as "D" represents current flowing out of the plane of the figure, the resultant Lorentz force associated with the radial flux through coil 16 exerts a force F downward on the permanent magnets 14*a* and 14*b* and armature rod 12 assembly as shown in FIG. 7A. Simultaneously, the solenoid magnetic field associated with coil 16 opposes the magnetic field within armature rod 12 that is generated by the penetrating lower permanent magnet 14*b*, thus negating the high magnetic permeance path that created the latching force in the first place. Accordingly, the latching force described in respect of FIG. 5B is no longer present within actuator 10 and this in combination with the Lorentz force causes armature rod 12 and associated permanent magnets 14*a* and 14*b* to move downwards.

Figure 7B:
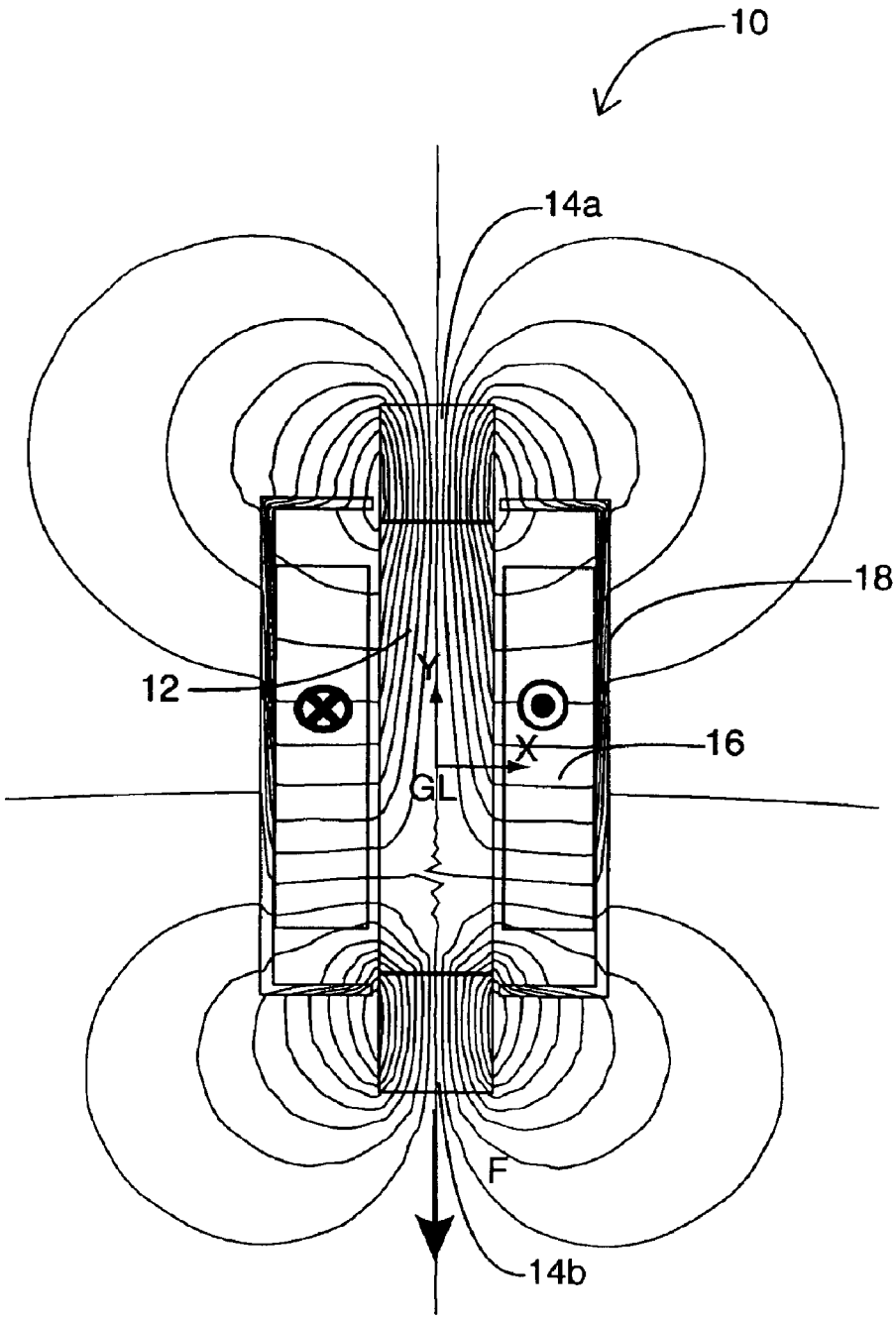
FIG. 7B is a schematic view showing the relationship between the magnetic field of the energized coil and the magnetic field associated with the actuator of FIG. 4 at the middle of a stroke.

FIG. 7B illustrates the magnetic field distribution associated with actuator 10 at the middle of an actuator stroke when coil 16 is energized by current flowing in the same direction as shown in FIG. 7A. As armature rod 12 moves downwards, the lower permanent magnet 14*b* moves away from the interior region of shield 18 and the upper permanent magnet 14*a* starts to penetrate the interior region of shield 18. The influence of the lower permanent magnet 14*b* that opposes the other flux sources within the armature rod 12 further diminishes. Although armature rod 12 is entirely within coil 16 throughout the stroke, the apparent penetration of armature rod 12 into coil 16 with respect to flux carrying capacity increases. Therefore, armature rod 12 behaves as a virtual solenoid. This solenoid like behavior operates in the same direction as the Lorentz force from the radial flux through the coil 16. Accordingly, the motive force of linear switch actuator 10 is the combination of this solenoid like behavior of armature rod 12 and the resultant force F from the Lorentz force.

Figure 7C:
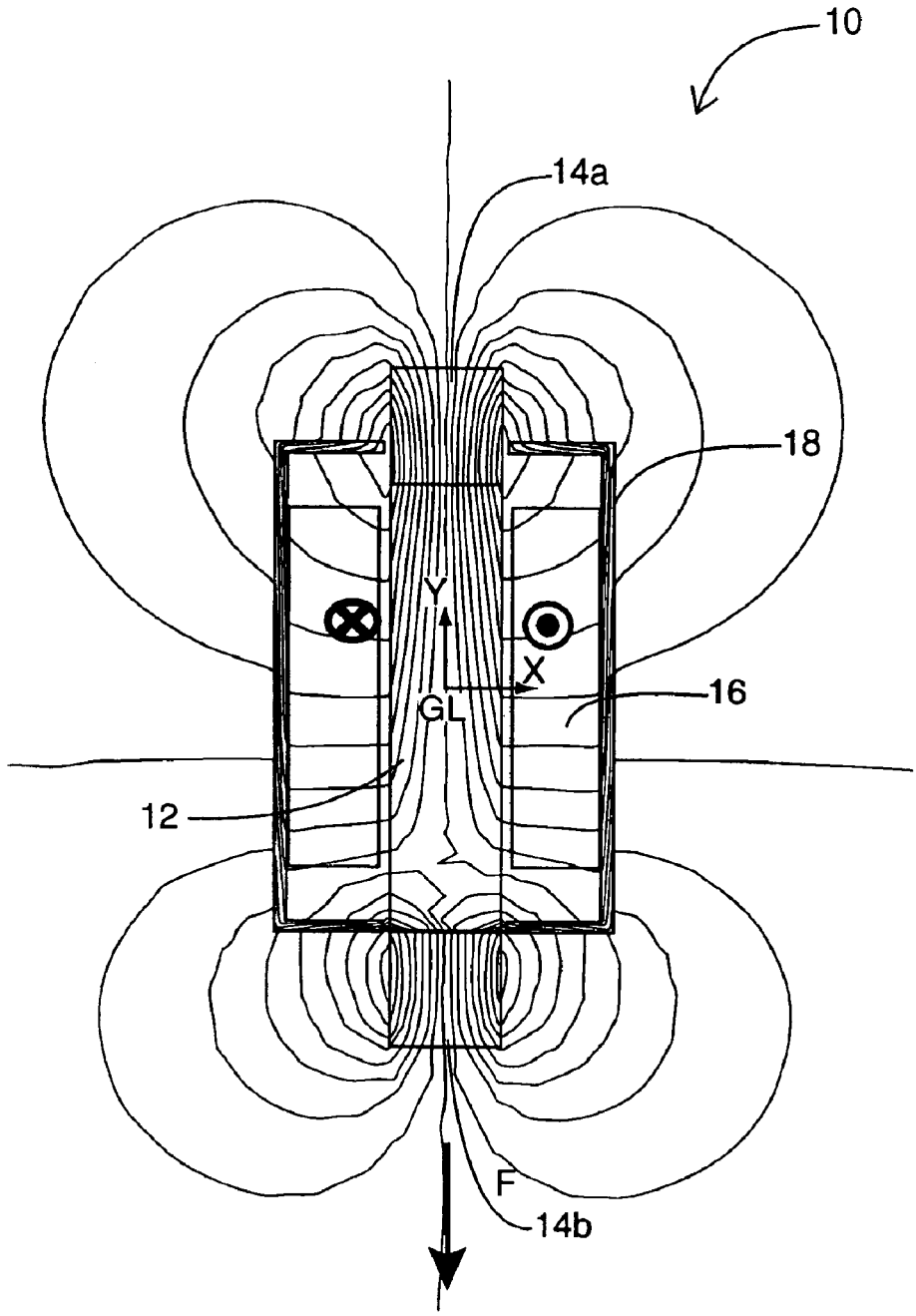
FIG. 7C is a schematic view showing the relationship between the magnetic field of the energized coil and the magnetic field associated with the actuator of FIG. 4 at the end of a stroke.

FIG. 7C illustrates the magnetic field distribution associated with actuator 10 at the end of an actuator stroke when coil 16 is energized by current flowing in the same direction as shown in FIG. 7A. The flux from the lower permanent magnet 14*b* is largely suppressed (i.e. isolated and localized from actuator rod 12) and the portion of the armature rod 12 within coil 16 contains flux in a single direction over the length of coil 16 as shown. The magnetic field created thereby will retain the permanent magnets 14*a* and 14*b* and armature rod 12 in the end actuator stroke position until the electric current is disconnected from coil 16. Upon removal of electric current from coil 16, the permanent magnets 14*a* and 14*b* and actuator rod 12 remain latched in the end actuator position in accordance with the latching mechanism as previously described.

The inventors contemplate that the thrust of linear switch actuator 10 is approximately 40% larger than the thrust associated with a conventional voice coil actuator of similar size that only harnesses the Lorentz force. In addition, a conventional voice coil actuator requires alternate latching means for switch application. Increasing the number of turns of the coil within the actuator does not have the same effect as in the case of voice coil actuators, because most of the coil generated magnetic flux is oriented along the armature axis and as such its flux density is less dependent of the coil thickness. Similarly, it is also contemplated that linear switch actuator 10 is advantageous over solenoid actuators in view of the fact that solenoid actuators are typically weak at start of a stroke and require additional means for latching and return stroke.

Figure 8A:
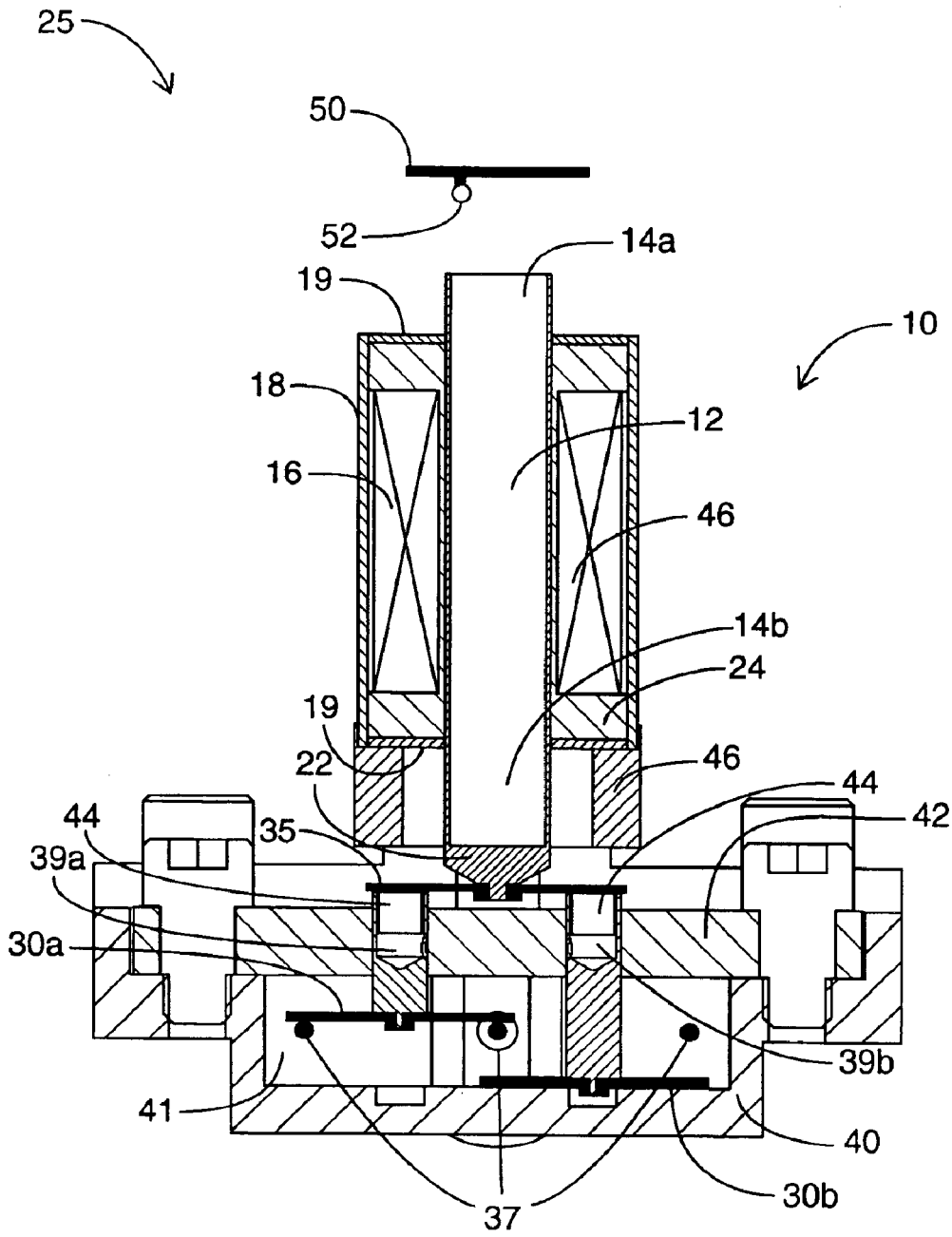
FIG. 8A is a cross-sectional view of the linear switch actuator of FIG. 4 implemented within a conventional RF SPDT switch.
Figure 8B:
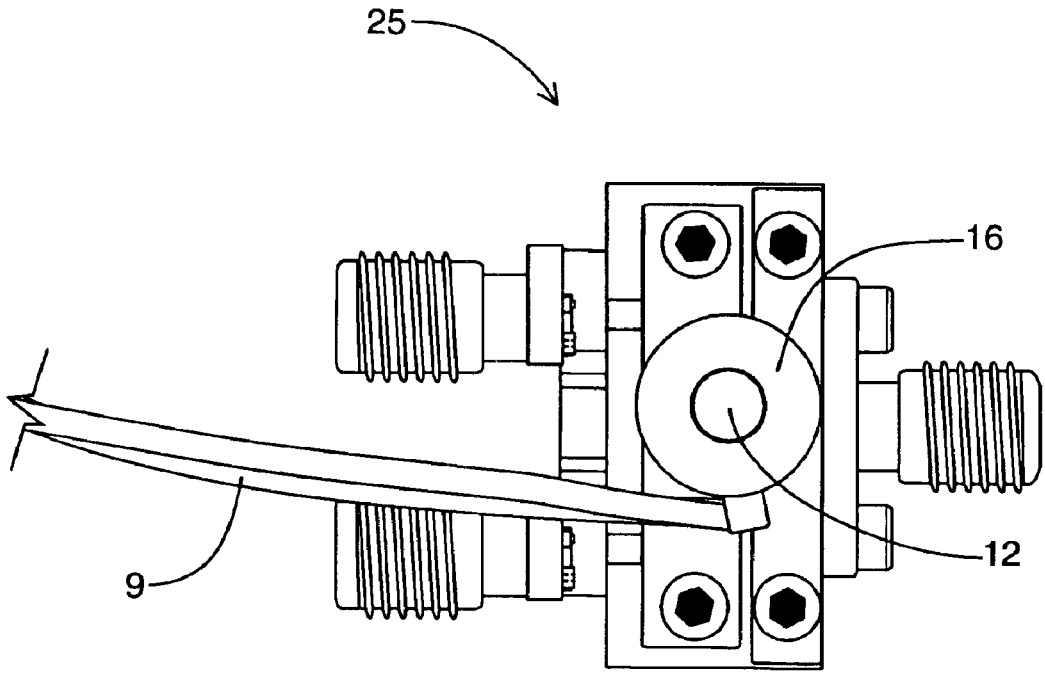
FIG. 8B is a top view of a prototype model of the implementation of FIG. 8A.

FIGS. 8A and 8B illustrate linear switch actuator 10 implemented within a conventional Radio Frequency Single Pole Double Throw (RF SPDT) switch 25. Specifically, linear switch actuator 10 can be used within SPDT switch 25 to simultaneously actuate both RF reeds 30*a* and 30*b* as will be described. As shown in FIG. 8A, SPDT switch 25 contains RF components, an actuator (e.g. linear switch actuator 10) and a telemetry/command interface components. The RF components include RF reeds 30*a* and 30*b*, ferromagnetic spring 35, RF probes 37, RF reed pistons 39*a* and 39*b*, RF reed magnets 44, a RF channel, a RF housing 40, and a RF cover 42. The telemetry/command interface components include a telemetry printed circuit board (PCB) 50 and a telemetry relay 52. This contains a magnetic SPDT relay actuated, without mechanical contact, by the corresponding actuator magnet and provides the position indication. The output can be as bi-level, resistive or both. Actuator 10: is attached to SPDT switch 25 by coupling shield 18 at one end to a support 46 preferably using epoxy bonding. Actuator piston 22 is also interlocked with ferromagnetic spring 35 as shown in FIG. 8A. Also, current is provided to coil 16 through wire 9 as shown in FIG. 8B. Ferromagnetic spring 35 is used as an interface between the two RF reeds 30*a* and 30*b*. The mechanism for latching the RF reeds 30*a* and 30*b* is provided by the internal latching of linear switch actuator 10.

As conventionally known, a coaxial waveguide path is in the transmission state when a RF reed 30*a* or 30*b* is moved away from the ground plane and into contact with the RF probes 37. When RF reeds 30*a* or 30*b* are in contact with RF probes 37, a continuous coaxial transmission line exists between the associated RF probes 37. The path geometry has been designed to provide an input impedance of 50 ohms. The waveguide path is in the non-transmitting state when a RF reed 30*a* or 30*b* is pulled against the ground plane (i.e. either against RF cover 42 or RF housing 40 as appropriate). In this state a waveguide transmission line now exists between the two corresponding RF probes 37. The geometry of the waveguide has been designed so that the cutoff frequency is much higher than the operating frequency of the device. Thus a high level of isolation exists between the two ports associated with a non-transmitting path. In each of the two distinct states of the switch, one RF path is in transmission while the other is in isolation mode.

SPDT switch 25 uses a ferromagnetic spring 35 to actuate RF reeds 30*a* and 30*b* (i.e. conductors) that connect or isolate the interface RF probes 37. Switch actuation is accomplished by supplying SPDT switch 25 with a fixed length DC command pulse, after which SPDT switch 25 remains in a latched position without the application of any electrical current. When the actuator coil 16 is energized with a given polarity, actuator piston 22 is moved downwards under the action of the various magnetic forces described above. Correspondingly, ferromagnetic spring 35 pushes the RF reed pistons 39*a* and 39*b* downwards until RF reed 30*a* associated with the shorter RF reed piston 39*a* is in contact with RF probes 37 and the RF reed 30*b* associated with the longer RF reed piston 39*b* is grounded on RF housing 40. In this position, even after the DC pulse is removed, a latching force exists pushing RF reeds 30*a* and 30*b* against RF probes 37 and RF housing 40, respectively without any need for any electrical input.

When actuator coil 16 is energized with opposed polarity, a force having opposite direction is produced and actuator piston 22 moves upwards. The ferromagnetic spring 35 attracts the reeds permanent magnets 44 which in turn move the RF reeds 30*a* and 30*b* in the opposite direction until the RF reed 30*a* associated with the shorter RF reed piston 39*a* is grounded on RF cover 42 and the RF reed 30*b* associated with the longer RF reed piston 29*b* is in contact with the corresponding RF probes 37. In this position also, after the DC pulse is removed, there is a latching force pushing the RF reed 30*a* against the RF probes 37 and grounding RF reed 30*b* against RF housing 40 without any need for an electrical input.

Accordingly, the RF components comprise two sets of reed/piston assemblies (each set comprising a RF reed piston 39*a*/39*b* and an RF reed 30*a*/30*b*) that define the two unique RF configurations as discussed above. These RF reeds 30*a*/30*b* are moved in and out of the waveguide paths 41 (i.e. RF channel) in the RF housing 40 via the interaction between permanent magnets 44 attached to RF reeds 30*a*/30*b* and the ferromagnetic spring 35 connected to actuator piston 22. RF housing 40 contains RF channel 41 and RF cover 42 contains the bores in which the above-noted reed/piston assemblies move. Dielectric guide-pins (not shown) are installed into the RF channel 41 to prevent RF reeds 30*a* and 30*b* from making electrical contact with the sides of RF channel 41. RF cover 42 completes the waveguide path.

FIG. 8B illustrates a prototype of an implementation of linear switch actuator 10 within SPDT switch 25 that the inventors have built and tested. It should be understood that FIGS. 8A and BB illustrate just one example implementation of linear switch actuator 10 within the particular RF reed structure of the RF SPDT switch 25 and that linear switch actuator 10 can be used to actuate various RF reed structures within many other types of RF switches such as T-switches, transfer (C–) switches, and Single Pole n Throw (SPnT) switches, switch matrices, redundancy switch configurations (i.e. redundancy rings) etc.

Figure 9:
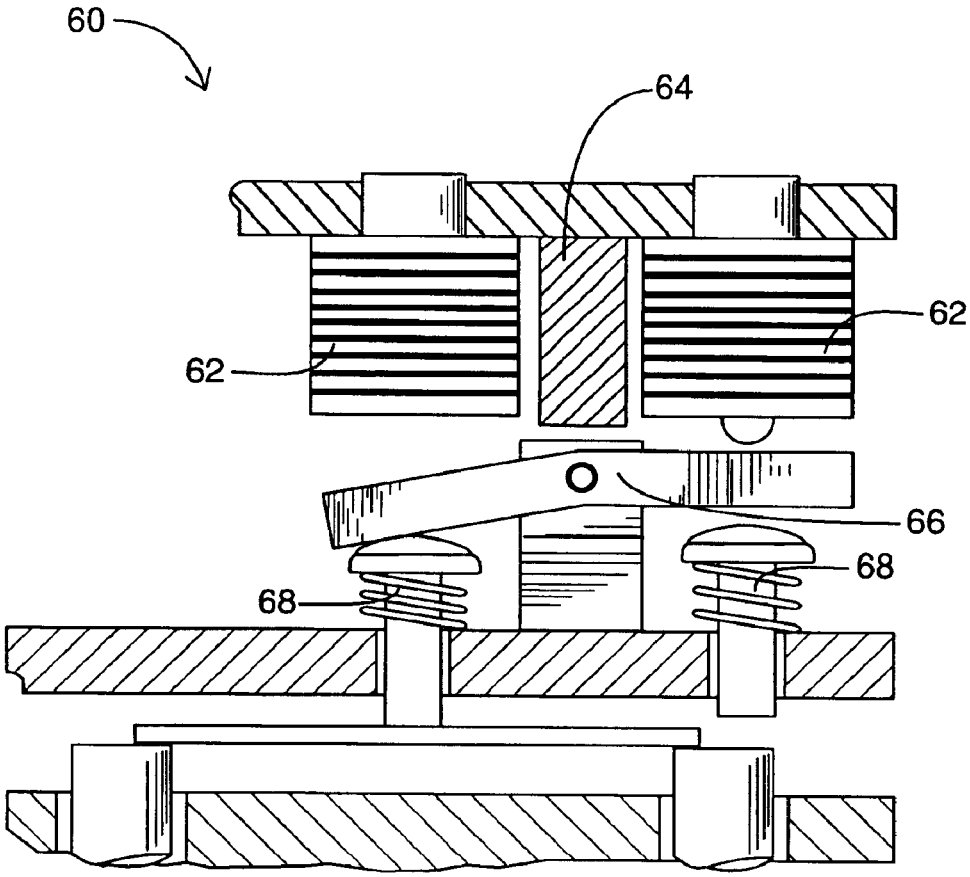
FIG. 9 PRIOR ART
FIG. 9 is a side view of the actuator associated with a prior art conventional microwave switch for comparison purposes.

As an illustration of the substantial reduction in component complexity, it is worthwhile comparing FIG. 8A to FIG. 9. FIG. 9 illustrates the components of a conventional microwave switch 60. In order to achieve switching, conventional microwave switch 60 requires two electromagnet actuators 62, a latching magnet 64, bearings 66 and springs 68. This is in sharp contrast to the use of only one linear actuator 10 consisting of coil 16 and armature 12 within linear switch actuator 10 as described above.

As will be apparent to those skilled in the art, various modifications and adaptations of the structure described above are possible without departing from the present invention, the scope of which is defined in the appended claims.

What is claimed is:

1. A linear switch actuator for actuating a movable element within a microwave switch, said linear switch actuator comprising:

(a) a ferromagnetic shield having a hollow tubular portion and first and second end plates, and first and second apertures formed within said first and second end plates, said shield defining a single and uninterrupted internal region that extends between the inside surfaces of the hollow tubular portion:

(b) a magnetic coil having a longitudinal axis and positioned within the interior region of said shield and adapted to receive an energizing current;

(c) a moveable armature assembly adapted to be coupled to the movable element and positioned along the longitudinal axis of said coil and extending through the first and second apertures of said shield, said armature assembly being moveable between a first stroke end position and a second stroke end position, said armature assembly comprising:

(i) a ferromagnetic rod having a first end and a second end;

(ii) a first permanent magnet coupled to said first end of the rod and positioned within said first aperture, said first permanent magnet having a first pole orientation and being positioned substantially outside said shield at the first stroke end position;

(iii) a second permanent magnet being coupled to said second end of said rod and positioned within said second aperture and having a second pole orientation opposite to that of the first pole orientation, said second permanent magnet and being positioned substantially outside said shied at the second stroke end position;

(d) such that when said armature assembly is positioned at one of said first and second stroke end positions, the magnetic permeance associated with said armature assembly is maximized due to one of said first and second permanent magnets being positioned substantially outside said shield, resulting in bi-stable latching between said first and second stroke end positions; and (e) such that when said energizing current is applied to said coil, said armature assembly moves between said first and second stroke end positions due to the combination of the force exerted on said armature assembly due to the magnetic interaction between said energized coil and the field associated with said first and second permanent magnets and the solenoid magnetic field associated with said coil which reduces the magnetic permeance associated with said armature assembly.

2. The actuator of claim 1, wherein said actuator further comprises an actuator piston coupled to one of said first and second permanent magnets, said actuator piston being adapted to engage said movable element.

3. The actuator of claim 1, wherein said shield includes a first ferromagnetic end plate containing said first aperture and a second ferromagnetic end plate containing said second aperture, such said first permanent magnet is positioned substantially past first ferromagnetic end plate at the first stroke end position and said second permanent magnet is positioned substantially past said second ferromagnetic end plate at the second stroke end position.

4. The actuator of claim 1, wherein said first and second permanent magnets are oriented such that the magnetic bias of each of said first and second permanent magnet is oriented axially with respect to the longitudinal axis of said coil.

5. The actuator of claim 1, further including a current source coupled to said coil, said current source being adapted to energize said coil by providing said energizing current to the coil in a first direction.

6. The actuator of claim 5, wherein said coil is made from bi-filar magnetic wire such that said actuator operates using an unipolar command circuit.

7. The actuator of claim 1, further including a current source coupled to said coil, said current source being adapted to energize said coil by providing said energizing current to the coil in first and second directions such that said actuator operates in a bi-polar manner.

* * * * *

UNITED STATES PATENT AND TRADEMARK OFFICE

CERTIFICATE OF CORRECTION

PATENT NO. : 6,870,454 B1
APPLICATION NO. : 10/656257
DATED : March 22, 2005
INVENTOR(S) : Mihai Vladimirescu and Regina Kwiatkowski It is certified that error appears in the above-identified patent and that said Letters Patent is hereby corrected as shown below:

Column 5, line 66, the reference numeral "16" has been changed to --18--, so that the line reads --18 and armature rod 12 permits actuator 10 to smoothly--.

Column 10, line 1, the reference numeral "BB" has been changed to --8B--, so that the line reads --FIGS. 8A and 8B illustrate just one example implementation--.

Column 10, line 33, claim 1, the phrase "tubular portion:" has been changed to --tubular portion;--, so that the line reads --of the hollow tubular portion;--.

Column 10, line 55, claim 1, the phrase "said shied at" has been changed to --said shield at--, so that the line reads --substantially outside said shield at the second stroke and--.

Signed and Sealed this

Eighteenth Day of August, 2009

David J. Kappos

David J. Kappos
*Director of the United States Patent and Trademark Office*